US007147398B2

(12) United States Patent
Liew et al.

(10) Patent No.: US 7,147,398 B2
(45) Date of Patent: Dec. 12, 2006

(54) COUPLER FOR FLEXIBLE SCAFFOLD SYSTEM

(75) Inventors: Jat Yuen Richard Liew, Singapore (SG); Binbing Wang, Singapore (SG)

(73) Assignee: National University of Singapore, Singapore (SG)

( * ) Notice: Subject to any disclaimer, the term of this patent is extended or adjusted under 35 U.S.C. 154(b) by 0 days.

(21) Appl. No.: 10/925,542

(22) Filed: Aug. 24, 2004

(65) Prior Publication Data

US 2005/0019095 A1 Jan. 27, 2005

Related U.S. Application Data

(62) Division of application No. 10/081,330, filed on Feb. 20, 2002, now Pat. No. 6,786,302.

(51) Int. Cl.
*F16D 1/00* (2006.01)

(52) U.S. Cl. ..... 403/169; 403/348; 403/375

(58) Field of Classification Search ..... 403/375, 403/348–352, 169–170

See application file for complete search history.

(56) References Cited

U.S. PATENT DOCUMENTS

| | | | | |
|---|---|---|---|---|
| 2,165,221 | A * | 7/1939 | Burton | 403/286 |
| 2,194,883 | A * | 3/1940 | Burton | 403/385 |
| 3,999,825 | A | 12/1976 | Cannon | |
| 4,355,922 | A | 10/1982 | Sato | |
| 4,426,171 | A * | 1/1984 | Layher | 403/49 |
| 4,443,128 | A | 4/1984 | Yamamoto et al. | |
| 4,566,819 | A | 1/1986 | Johnston | |
| 4,639,979 | A | 2/1987 | Polson | |
| 4,660,870 | A * | 4/1987 | Donley | 285/419 |
| 5,167,466 | A | 12/1992 | Hsieh | |
| 5,259,690 | A | 11/1993 | Legge | |
| 5,427,465 | A | 6/1995 | Sato | |
| 6,004,063 | A | 12/1999 | Adams, Sr. | |
| 6,168,345 | B1 | 1/2001 | Legge | |
| 6,702,509 | B1 * | 3/2004 | Rogers | 403/385 |

FOREIGN PATENT DOCUMENTS

| | | |
|---|---|---|
| DE | 878880 | 6/1953 |
| DE | 1684361 | 10/1970 |
| DE | 2753067 | 5/1979 |
| FR | 2234804 | 1/1975 |
| GB | 2081797 | 2/1982 |
| JP | 11172912 A | 6/1999 |
| WO | WO88/06222 | 8/1988 |

* cited by examiner

*Primary Examiner*—Daniel P. Stodola
*Assistant Examiner*—Joshua T. Kennedy
(74) *Attorney, Agent, or Firm*—Thorpe North & Western LLP

(57) ABSTRACT

A two coupler apparatus for interconnecting two scaffolding members wherein at least one coupler is defined by: a base interconnected to a second coupler and a lever hinged to the base. The base and the lever define a pocket for laterally receiving a length of a scaffold member. An arm is hinged to the base and the lever has a slot sized to receive the arm. The arm defines a hole positioned to extend beyond the lever when the arm is within the slot. A wedge is adapted for insertion through the hole to slidably move against the lever when the arm extends within the slot to wedge the arm within the lever whereby the scaffold member is locked within the at least one coupler.

14 Claims, 7 Drawing Sheets

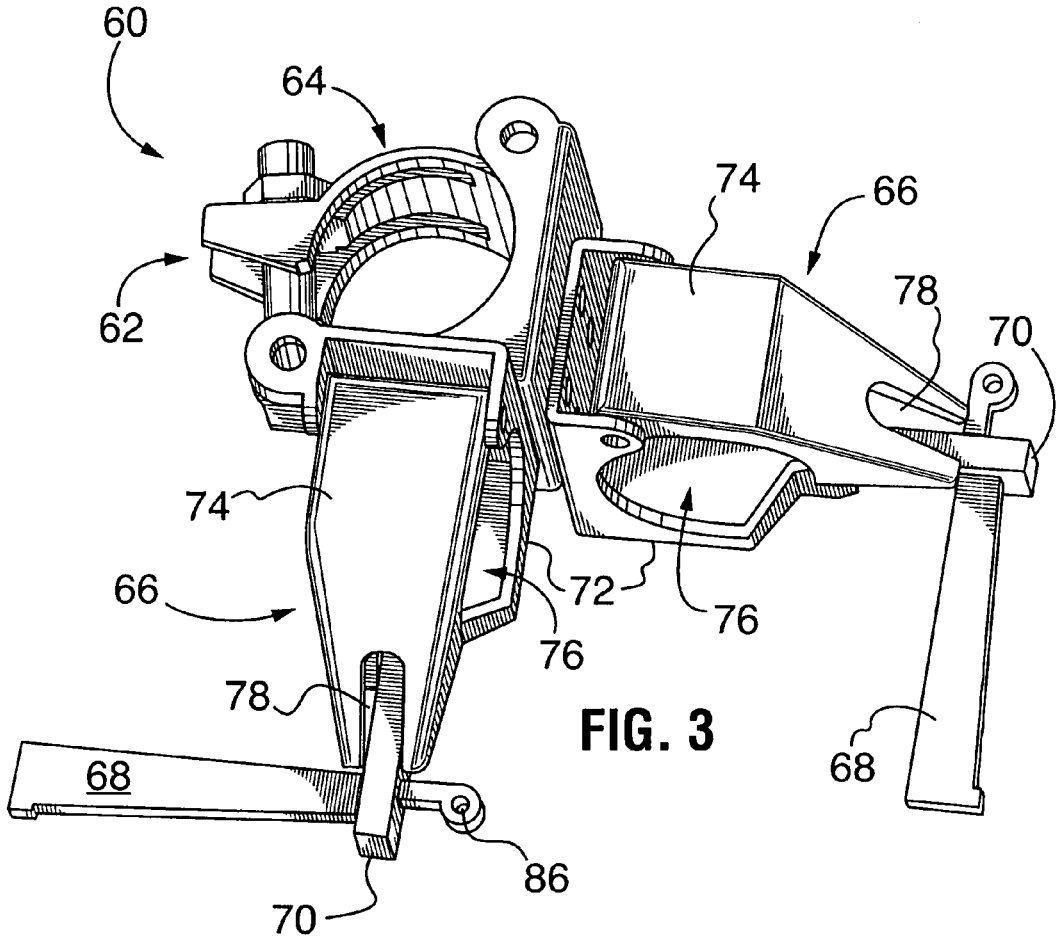
FIG. 3
FIG. 4
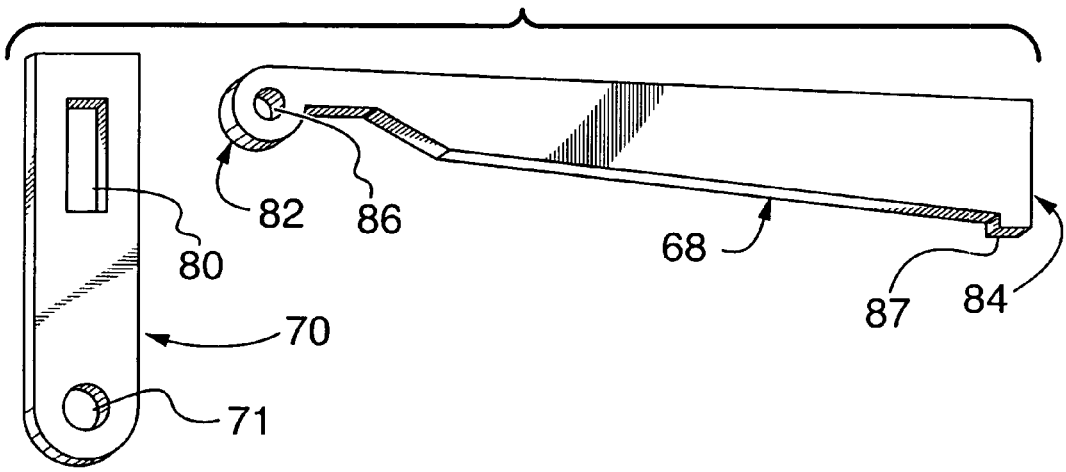

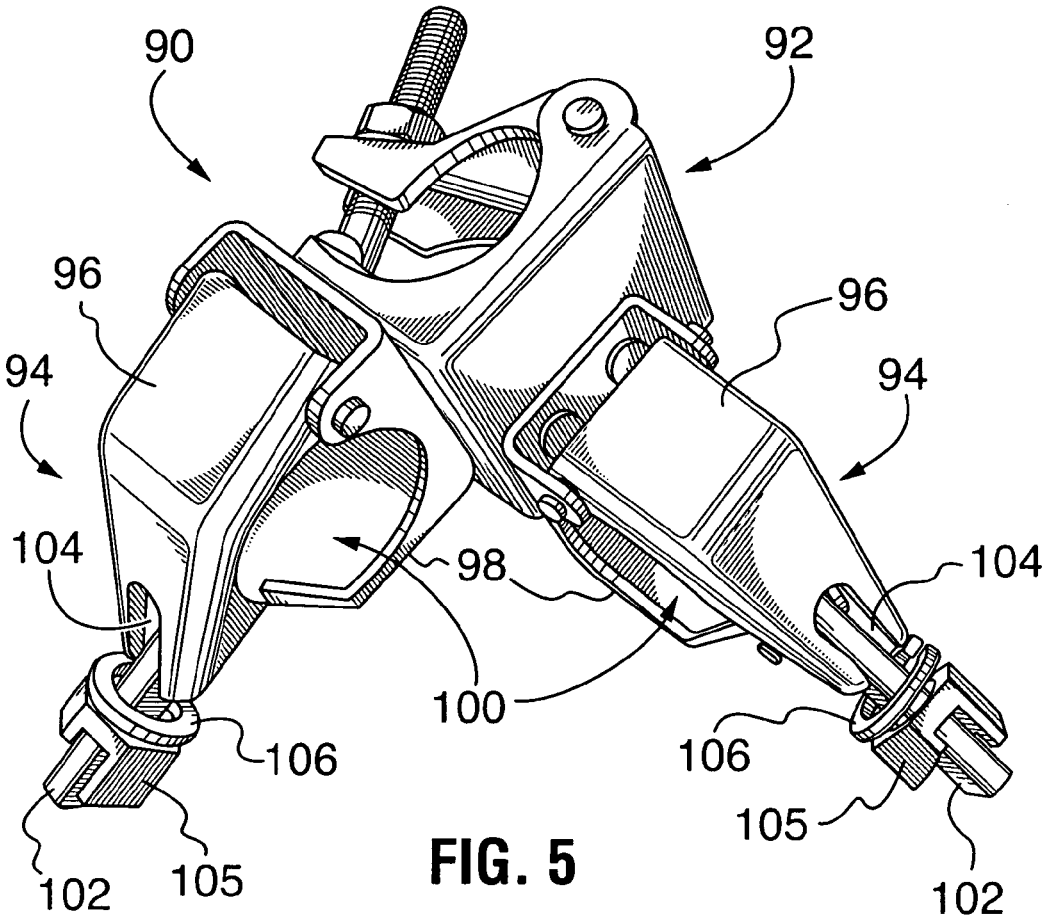
FIG. 5
FIG. 6A
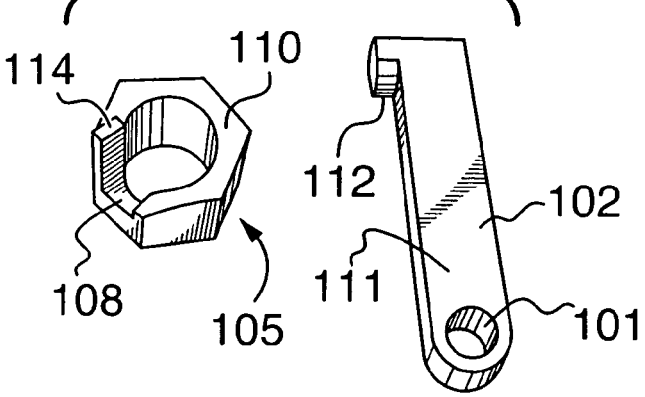
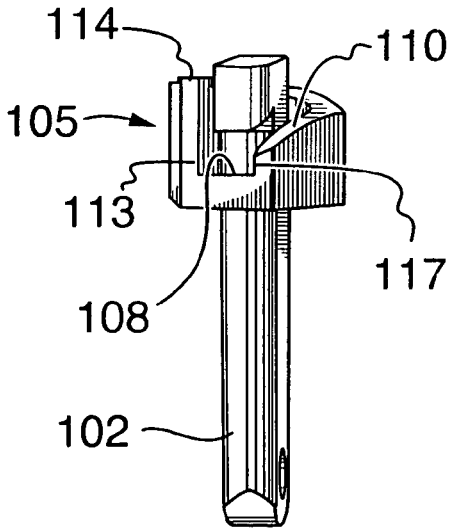
FIG. 6B

COUPLER FOR FLEXIBLE SCAFFOLD SYSTEM

This application is a divisional application of U.S. patent application Ser. No. 10/081,330, filed Feb. 20, 2002 now U.S. Pat. No. 6,786,302.

FIELD OF THE INVENTION

This invention relates to couplers and more particularly to couplers for interconnecting scaffolding.

BACKGROUND OF THE INVENTION

Scaffolding is commonly constructed from lengths of steel or aluminum tubes interconnected to each other to form an open structural framework. The size and configuration of the structure depends on the application. The interconnection of the tubes is normally made by two right angle couplers ("double couplers") which are joined together. One of these double couplers can interconnect two of the three tubes that will normally meet at a right angle crossing of a scaffold structure. A second double coupler is required to interconnect a third tube to the first two.

The couplers are normally locked to the tubes by one or more nut and bolt locking devices. However, such couplers suffer from disadvantages. Their fastening and unfastening is time consuming and is inconvenient in requiring use of a wrench. Additionally, two hands are normally required to hold the coupler during the initial stages of fastening and the nuts and bolts are often corroded, making it difficult to thread and tighten the nuts. Also, the locking device may be under or over tightened on the tubes, leading to slipping or thread stripping respectively, which may compromise the safety of the scaffold structure.

SUMMARY OF THE INVENTION

The invention may be summarised according to a first broad aspect as a coupling apparatus for interconnecting three scaffold members comprising: a support coupler and two connector couplers for attachment to three scaffold members; the support coupler having a base interconnected to the connector couplers, a lever hinged to the base, and a locking device, the base and the lever defining a pocket for laterally receiving a length of a scaffold member; the connector couplers each defining a pocket for receiving a length of a scaffold member and having a locking device; each of the locking devices being movable from a release condition, to allow a scaffold member to be positioned in or removed from the pocket, to a locked position, to secure the scaffold member in the coupler; wherein the pockets are oriented to secure three scaffold members at relative angles to each other.

The invention may be summarised according to a second broad aspect as a two coupler apparatus for interconnecting two scaffolding members wherein at least one coupler is defined by: a base interconnected to a second coupler; a lever hinged to the base, the base and the lever defining a pocket for laterally receiving a length of a scaffold member; an arm hinged to the base; the lever having an slot sized to receive the arm; the arm defining a hole positioned to extend beyond the lever when the arm is within the slot; a wedge adapted for insertion through the hole to slidably move against the lever when the arm extends within the slot to wedge the arm within the lever whereby the scaffold member is locked within the at least one coupler.

The invention may be summarised according to another broad aspect as a two coupler apparatus for interconnecting two scaffolding members wherein at least one coupler is defined by: a base interconnected to a second coupler; a lever hinged to the base, the base and the lever defining a pocket for laterally receiving a length of a scaffold member; an arm hinged to the base, the arm having a protrusion at a free end; the lever having an slot adapted to receive the arm; a circular wedge pivotally mounted on the arm, the circular wedge circumferentially increasing in thickness to define a cam surface for engagement with the protrusion; the circular wedge being rotatable on the arm between the lever and the protrusion in a direction of increasing thickness to create a wedging action between the protrusion and the cam surface acting to press the lever onto the scaffold member to lock the scaffold member within the pocket.

The invention may be summarised according to a further broad aspect as a two coupler apparatus for interconnecting two scaffolding members wherein at least one coupler is defined by: a base interconnected to a second coupler; a lever hinged to the base, the base and the lever defining a pocket for laterally receiving a length of a scaffold member; an over-centre hand-lever mechanism for intercoupling the base and the lever, the over-centre hand-lever mechanism having an adjustable length and being selectively actuatable when intercoupling the base and the lever to lock the lever and the base to a scaffold member.

Advantageously, the triple coupler allows three scaffold members to be interconnected with only one coupling apparatus thereby replacing the two double couplers normally used. Assembly is then achieved by the handling of one apparatus instead of two.

Additionally, the angle between the three scaffold members can be fixed by the triple coupler. This eliminates the need to adjust the angle of a second double coupler relative to a first double coupler as is necessary where two double couplers are used.

Specific embodiments of the couplers, namely the wedge coupler, the circular wedge coupler and the hand-lever coupler, have the advantage that they do not rely on threaded bolts and nuts to fasten the couplers around the scaffold members. This eliminates the problems of stripped or rusted threads associated with bolt-and-nut locking devices.

Additionally, the hand-lever coupler may be fastened or unfastened quickly without the use of any hand tools.

Also, the wedge coupler and the circular wedge coupler are simple to fabricate, may be fastened or unfastened rapidly and the circular wedge coupler has no separable parts.

Other aspects and features of the invention will become apparent to those of ordinary skill in the art upon review of the following description of specific embodiments of the invention in conjunction with the accompanying figures.

BRIEF DESCRIPTION OF THE DRAWINGS

Preferred embodiments of the invention will now be described with reference to the attached drawings in which:

FIG. 3 is a perspective view of a wedge triple coupler.

FIG. 4 is an enlarged perspective view of a wedge and an arm used in the triple coupler of FIG. 3.

FIG. 5 is a perspective view of a circular wedge triple coupler.

FIG. 6A and FIG. 6B are perspective views of a circular wedge and arm, shown separately and assembled, respectively, of the triple coupler of FIG. 5.

DETAILED DESCRIPTION OF THE PREFERRED EMBODIMENT

Figure 1:
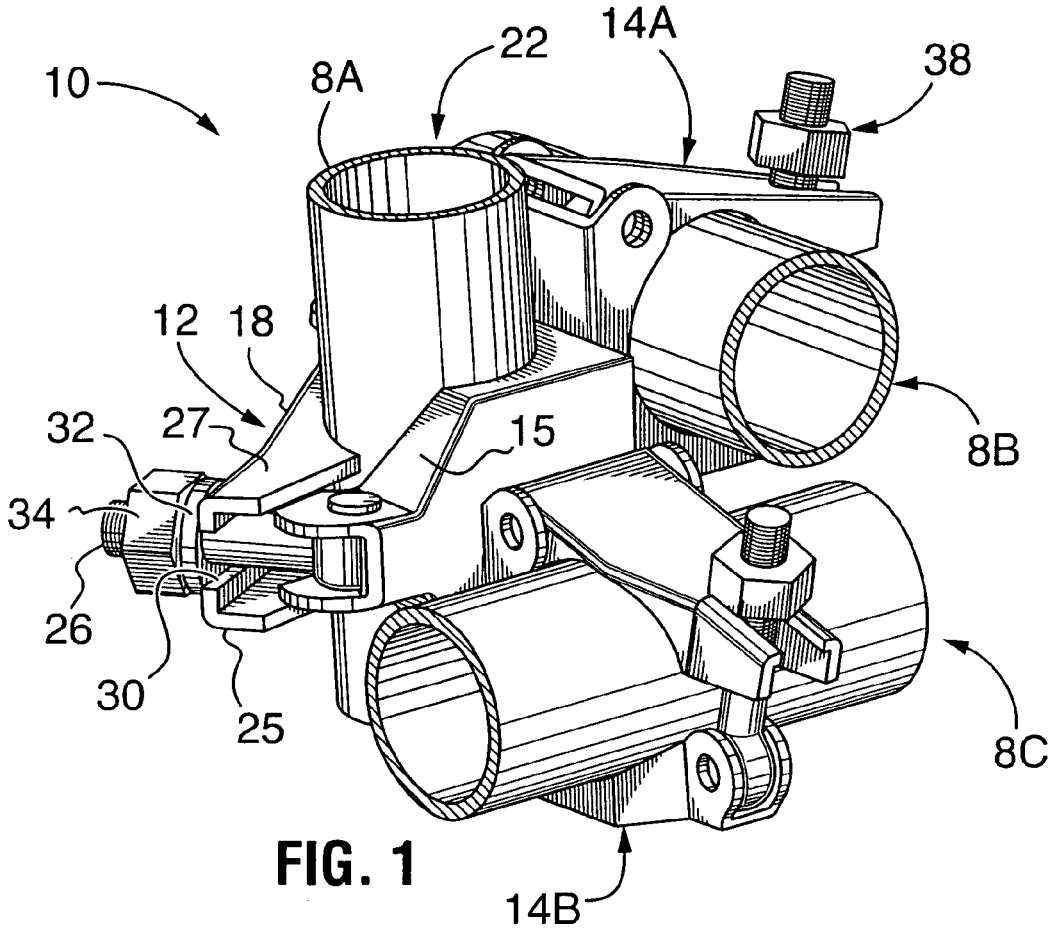
FIG. 1 is a perspective view of a bolt-and-nut triple coupler in which segments of scaffolding tubes are shown.

FIG. 1 depicts a triple coupler 10 interconnecting a vertical scaffold member 8A and two horizontal scaffold members 8B, 8C. The triple coupler 10 includes a heavy duty vertical support coupler 12 and two horizontal connector couplers 14A, 14B.

Figure 2:
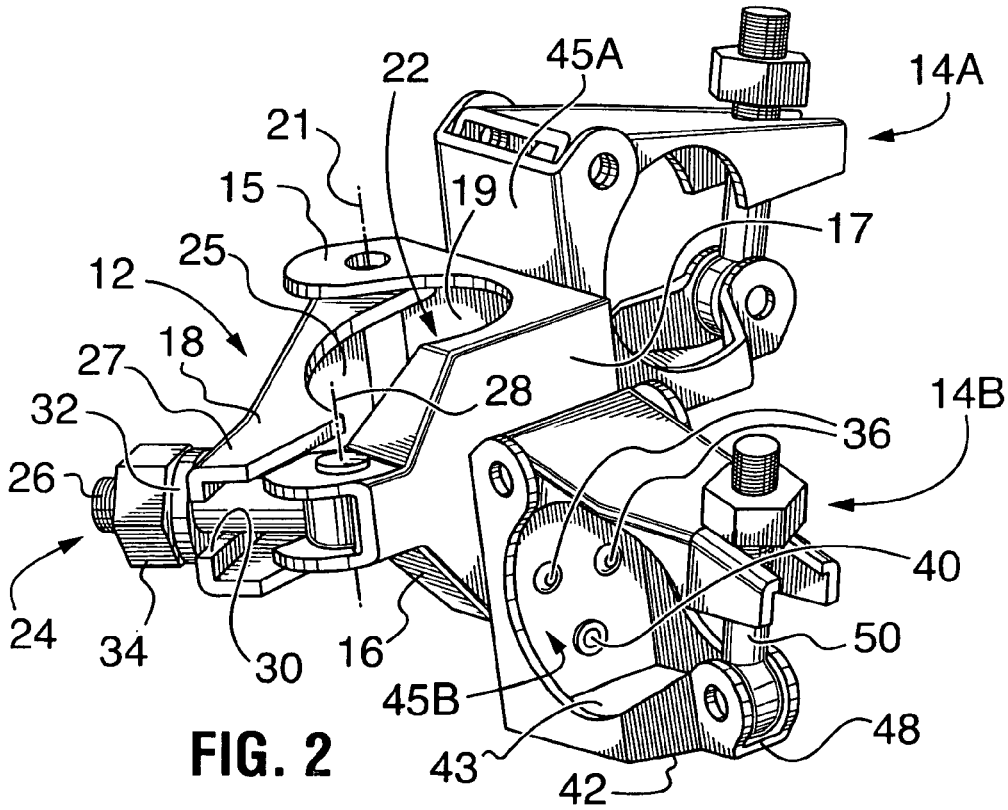
FIG. 2 is a perspective view of the bolt-and-nut triple coupler of FIG. 1.

FIG. 2 depicts a base 16 of the vertical support coupler 12. The base 16 has two plates 17, 19 joined at a right angle. Two flanges 15 extend at right angles from the edges of the plates 17, 19. The flanges 15 have inner edges that define an arcuate pocket 22. The flanges 15 have pair of registering holes that define a pivot axis 21 adjacent an outer end of the plate 19 and a pivot axis 28 adjacent an outer end of the plate 17.

The base 16 further includes a lever 18 defined by a plate 25 that has two flanges 27, and a horizontal slot 30 opening from the free end. The two flanges 27 extend from the free end of the plate 25 along its side edges and have inner edges that are arcuate. The lever 18 is pivotally connected, on the axis 21, to the flanges 15 on the base 16.

The coupler 12 includes a locking device 24 comprising a bolt 26, which is pivotally connected to the base 16 on the axis 28 at the opposite side of the pocket 22. A nut 34 is threaded on the bolt 26 which also carries a washer 32. The horizontal slot 30 receives the bolt 26 when the bolt 26 is rotated about the pivot axis 28 and into position shown in FIG. 1.

The vertical support coupler 12 is locked to the vertical scaffold member 8A by the locking device 24. The operation of the locking device 24 is as follows. The vertical scaffold member 8A (FIG. 1) is placed into the pocket 22. The lever 18 is then swung to close the flanges 27 around scaffold member 8A. The lever 18 thus closes the pocket 22. The flanges 27 and the flanges 15 grip the vertical scaffold member 8A (FIG. 1) when the vertical support coupler 12 is closed. The bolt 26 is then swung into the slot 30 in the lever 18 and the nut 34 rotated against the washer 32 to press the lever 18 into gripping engagement with the scaffold member 8A. Thus, when the nut 34 is tightened, the vertical scaffold member 8A is securely locked in the pocket 22 of the coupler 12.

The structure of each horizontal connector coupler 14A, 14B depicted in FIGS. 1 and 2 is basically the same as that of the vertical support coupler 12. Only the structure which differs will be described with reference to the lower horizontal connector coupler 14B. Unless otherwise specified, the structure of the upper horizontal connector coupler 14A is the same as that of the lower horizontal connector coupler 14B.

The lower horizontal connector coupler 14B has a stopper plate 48 near the pivot of a bolt 50. The stopper plate 48 prevents the bolt 50 from rotating too far from its locked position when it is released. The stopper plate 48 maintains the bolt 50 at an angle in the range of 10° to 15° from the plane of a horizontal plate 43 of a base 42.

The horizontal connector couplers 14A, 14B are rigidly fixed to the vertical support coupler 12 by rivets 36. As shown in FIGS. 1 and 2, the horizontal connector couplers 14A, 14B are offset and orthogonal to each other and to the vertical support coupler 12. The vertical plate 45B of the base 42 of the lower horizontal connector coupler 14B is riveted to the plate 17 of the vertical support coupler 16 and the vertical plate 45A of the upper horizontal connector coupler 14A is riveted to the plate 19 of the coupler 12 as is clearly shown in FIG. 2. The vertical plate 45B of the lower horizontal connector coupler 14B extends below the plate 17 of the coupler 12 and the vertical plate 45A of the upper horizontal connector coupler 14A extends above the plate 19 of the coupler 12. On a portion of the vertical plate 45B, which extends below the coupler 12, there is a reinforcing knot 40. The reinforcing knot 40 is a roughly semi-hollow-ball shaped protrusion formed in the vertical plate 45B. The reinforcing knot 40 prevents the bending of the vertical plate 45B by pressing against the vertical scaffold member 8A when a vertical force of the horizontal scaffold member 8C against the base 42 would otherwise tend to bend the portion of the vertical plate 45B extending below the base 16. A vertical plate 45A of the upper horizontal connector coupler 14A does not have a similar reinforcing knot.

Other locking devices may be utilized as exemplified in the following Figures. FIG. 3 depicts a triple coupler 60 which utilizes a bolt-and-nut locking device 62 to secure a vertical support coupler 64 as in FIGS. 1, 2. However, two horizontal connector couplers 66 utilize a different locking device.

The couplers 66 have a base 72 with flanges having arcuate inner edges which define a pocket 76. A lever 74 is hinged at one end to the base 72. The lever 74 also has flanges with arcuate inner edges. The lever 74 has an outwardly open slot 78 as in the levers of the bolt-and-nut couplers of FIGS. 1, 2. However, in the present embodiment, the bolt-and-nut have been replaced by an arm 70 and a wedge 68.

FIG. 4 depicts the wedge 68 separately from the arm 70. The arm 70 has a circular hole 71 adjacent one end and an elongate hole 80 adjacent the other end. The arm 70 is hinged to the base 72 by a pin (not shown) passing opposite the lever 74 through the hole 71. The wedge 68 has a wide end 84 with a stopper 87, and tapers to a narrow end 82, which has a hole 86 defined therein.

In use, a scaffold member (not shown) is positioned into the pocket 76 and the lever 74 is rotated to close the pocket 76 around the scaffold member. The arm 70 is then rotated into the slot 78 such that a portion of hole 80 extends above the lever 74. The small end 82 of the wedge 68 is slid through that portion of the hole 80. As the wedge 68 (driven by hammer blows) is advanced through the hole 80, the increasing taper of wedge 68 forces more of the arm above the lever 74. The lever 74 is thus pressed against the scaffold member within the pocket 76, thereby locking the scaffold member within the coupler 66.

The wedge 68 is also designed to be retained within the hole 80 even when it is not locked against the lever 74. In particular, the stopper 87 at the wide end 84 of the wedge 68 is sufficiently wide that it cannot fit through the hole 80 in the arm 70. A retaining means (not shown) such as a cotter pin, rivet, or other fastener, is inserted through the hole 86 in order to retain the wedge 68 within the hole 80.

FIG. 5 depicts a triple coupler 90 comprised of a bolt-and-nut coupler 92 and two circular wedge couplers 94. The bolt-and-nut coupler 92 is essentially as described with respect to FIGS. 1 and 2 but the two couplers 94 utilize another locking device. Each coupler 94 has a base 98, with flanges having arcuate inner edges, which defines a pocket 100. A lever 96 is hinged at one end to the base 98. The lever 96 also has flanges with arcuate inner edges and can be swung to close the pocket 100 around a horizontal scaffold member (not shown). The lever 96 has an outwardly open slot 104. This structure is the same as that of the bolt-and-couplers of FIGS. 1, 2. However, in the present embodiment, the bolt-and-nut have been replaced with an arm 102 and a circular wedge 105.

FIG. 6A depicts the arm 102 and the circular wedge 105 separately. The arm 102 has a hole 101 adjacent one end for pivotal attachment to base 98 and at its opposite end a protrusion 112 projecting perpendicular to an axis of the hole 101. The arm 102 is hinged to the base 98, opposite the lever 96, through the hole 101. The circular wedge 105 has a hexagonal outer surface and a circular inner surface. The circular wedge 105 has a depression 108, which defines the minimum thickness of the circular wedge 105. A tapered upper surface 110 which begins at a leading edge 117 of the depression 108 and extends around the circumference of the circular wedge 105 to a stopper 114 that divides the tapered upper surface 110 from a second edge 113 of the depression 108. When the circular wedge 105 is assembled onto the arm 102 (FIG. 6B) it can rotate freely about the shaft 111 of the arm 102 except when moved into engagement with the protrusion 112. The depression 108 is sufficiently wide to receive the protrusion 112. When the arm 102 is assembled to the coupler 96, a spring washer 106 (FIG. 5) is preferably positioned on the arm beneath the circular wedge 105.

The operation of the coupler 94 is as follows. A scaffold member (not shown) is placed within the pocket 100. The lever 96 is swung over the scaffold member and the arm 102 is rotated into the slot 104 in the lever 96. The circular wedge 105 rests against spring washer 106, which rests on the lever 96. The depression 108 rests against the protrusion 112. To tighten the locking device, the circular wedge 105 is pressed against the lever 96 and rotated to position the protrusion 112 against a leading edge 117 of the tapered upper surface 110. As the circular wedge 105 is further rotated (e.g. by use of a wrench), the wedge action of the surface 110 against the protrusion 112 presses the lever 96 against the scaffold member within the pocket 100, thereby locking the scaffold member to the coupler 96. The stopper 114 limits the rotation of the circular wedge 105 against the protrusion 112 thereby preventing the circular wedge 105 from being over-rotated. The spring washer 106 secures the circular wedge 105 against slipping once it is tightened.

Figure 7:
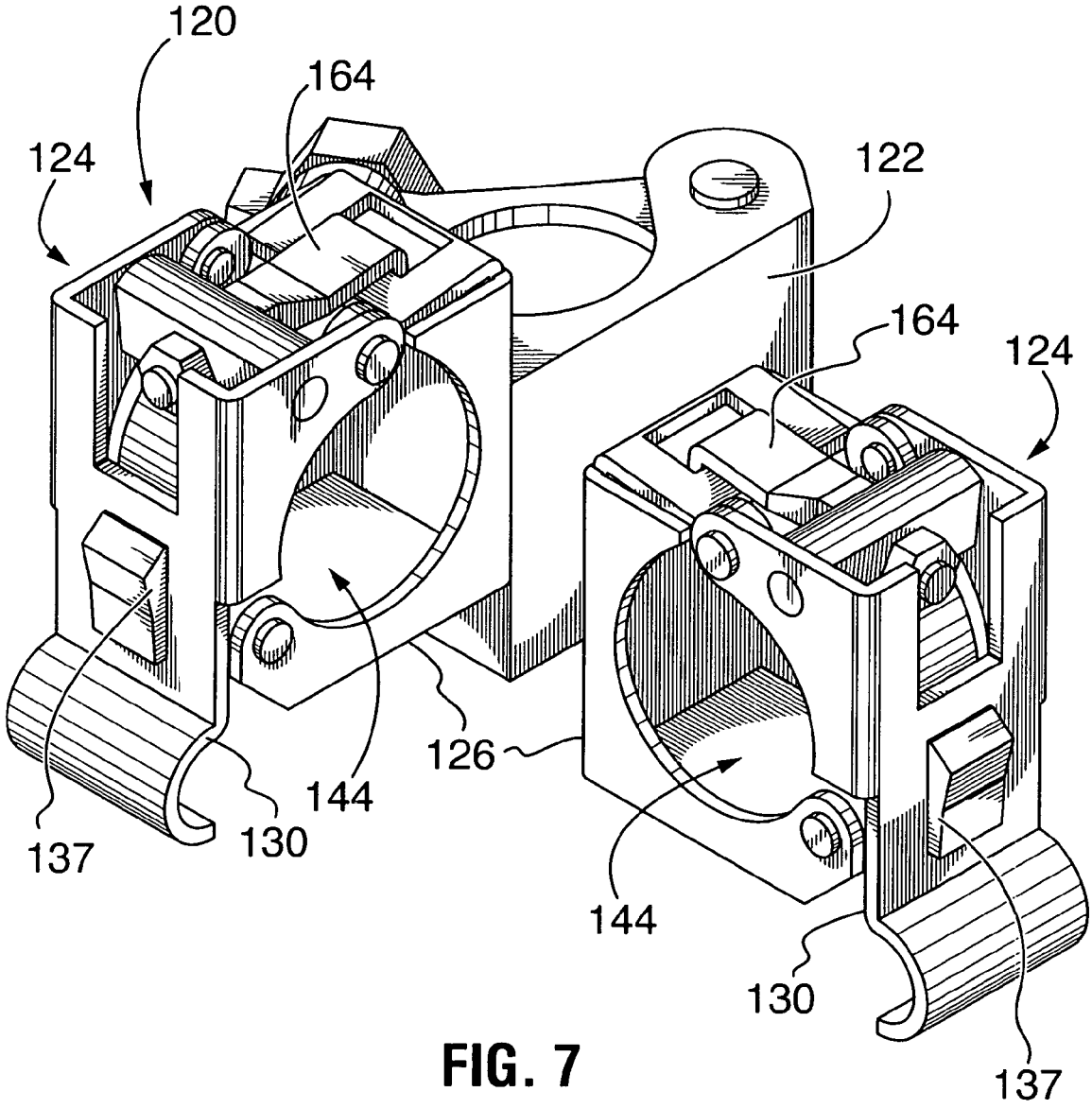
FIG. 7 is a perspective view of a hand-lever triple coupler.

A triple coupler 120 of FIGS. 7 to 10 include a bolt-and-nut vertical support coupler 122, as in FIGS. 1, 2 and two horizontal couplers 124. As best depicted in FIG. 8A, each coupler 124 has a base 126 with a rear vertical plate 214 and a bottom plate 213 joined at a right angle to a bottom edge of the rear vertical plate 214. A latch plate 209 is joined to the top edge of the rear vertical plate 214 and extends outwardly and slightly downwardly. A square hole 210 extends through the latch plate 209. Two flanges 211 extend along opposite edges of the plates 213, 214. The inner edges of the flanges 211 define a arcuate pocket 144 (FIG. 7). The flanges 211 have aligned holes 212 adjacent the outward end of the plate 213.

Figure 8A:
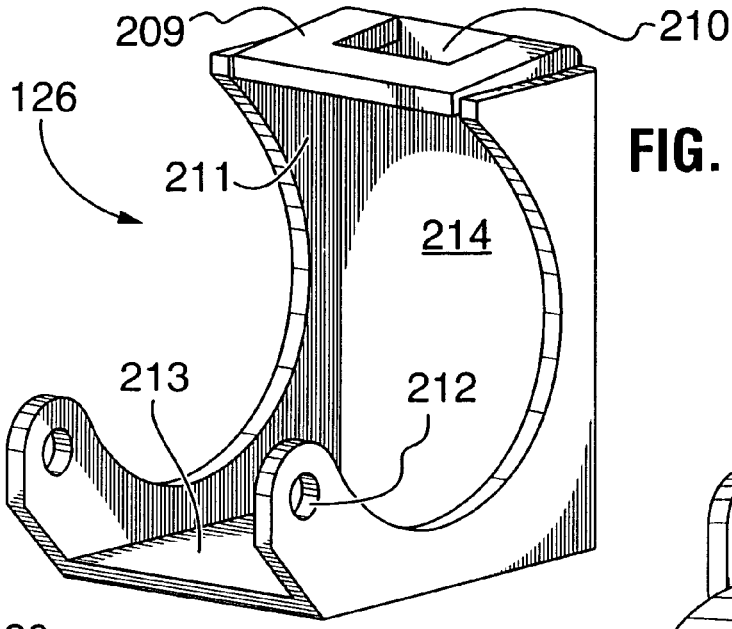
FIGS. 8A, 8B, 8C and 8D are perspective views of a base, an inner lever, a hand lever and a T-shaped catch assembly of the coupler of FIG. 7.
Figure 8B:
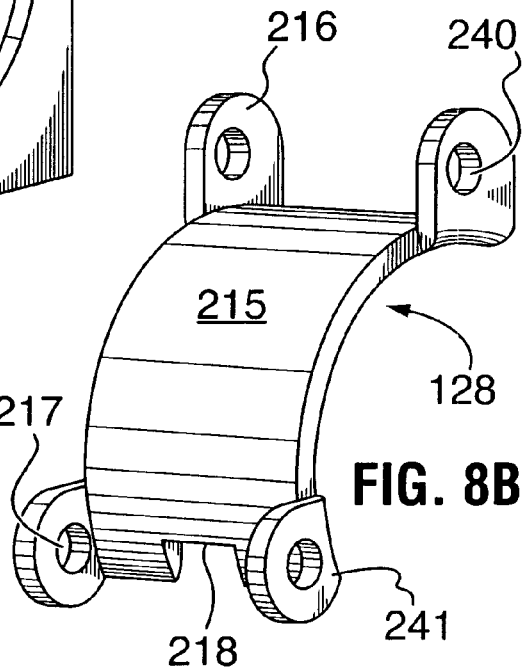

An inner lever 128 is hinged to the holes 212 of the base 126. The inner lever 128, as shown in FIG. 8B, has a curved plate 215 with a slot 218 defined at its lower edge. The curved plate 215 has two upper ears 216 at its upper corners and two lower ears 241 at its lower corners. Aligned holes 217 extend through each of the ears 241 and aligned holes 240 extend through each of the ears 216. A hinge pin 136 (FIG. 9, 10), extending through holes 212 and 217, pivotally connects inner lever 128 to the base 126.

Figure 8C:
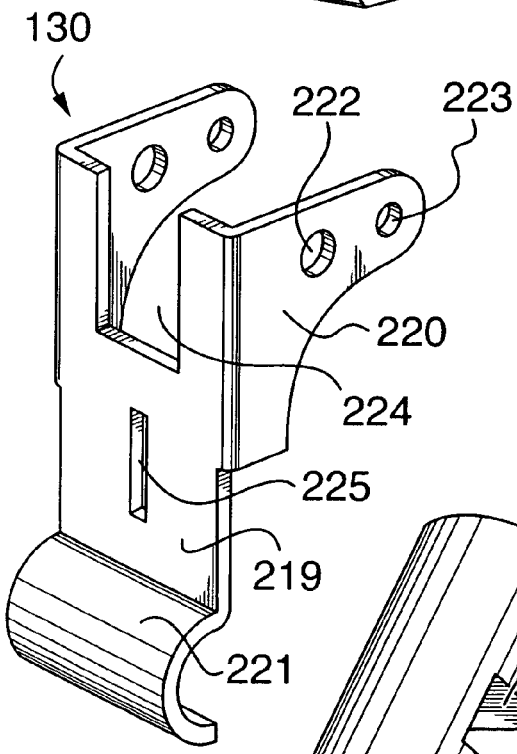

A hand lever 130 shown in FIG. 8C is also pivotally connected to the inner lever 128. The hand lever 130 has a main plate 219 with a curved handle 221 extending downward from its lower edge. A narrow elongate vertical hole 225 is cut through the centre of the main plate 219. A wide upwardly open slot 224 extends downward from the upper edge of the main plate 219. Two side plates 220 are joined at right angles to upper side edges of the main plate 219. Two aligned holes 223 are defined in the outermost ends of the side plates 220 and two aligned holes 222 are defined in the side plates 220 at a intermediate location. The specified hinge pin, 150 (FIGS. 9, 10) extend through pairs of holes 223 and 240 to pivotally connect hand lever 130 to the inner lever 128 as best seen in FIG. 9.

Figure 8D:
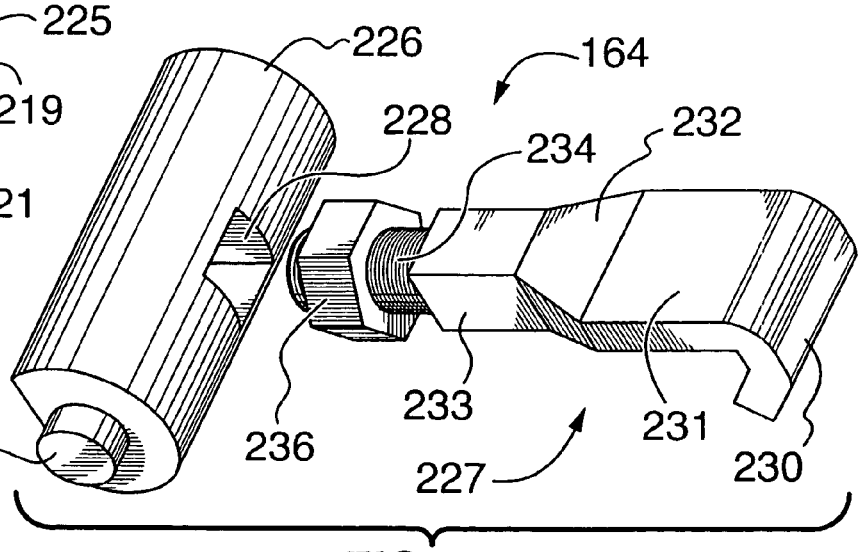

A T-shaped catch assembly 164 of FIG. 8D is comprised of a pin member 226 and a hook member 227. The pin member 226 has a circular protrusion 229 extending from each end. The protrusions 229 are slightly smaller in diameter than the holes 222 in the hand lever 130. The pin member 226 also has a square hole 228 extending through it. The hook member 227 has a plate 231 with a hook 230 at one end. Extending from an opposite end of the plate 231 is a tapered neck 232, which joins to a rectangular section 233 that is slightly smaller in size than the hole 228 in the pin member 226. The rectangular section 233 is joined to a bolt section 234 threaded for engagement by a nut 236.

To assemble the hook member 227 to the pin member 226, the bolt section 234 and the rectangular section 233 of the hook member are inserted through the hole 228 in the pin member 226. The nut 236 is then threaded onto the bolt section 234 to retain the pin member on the hook member. The T-shaped catch assembly 164 is then connected to the hand lever 130 by outwardly flexing the side plates 220 and inserting projections 229 of the pin member 226 into the holes 222 of the hand lever 130.

Figure 9:
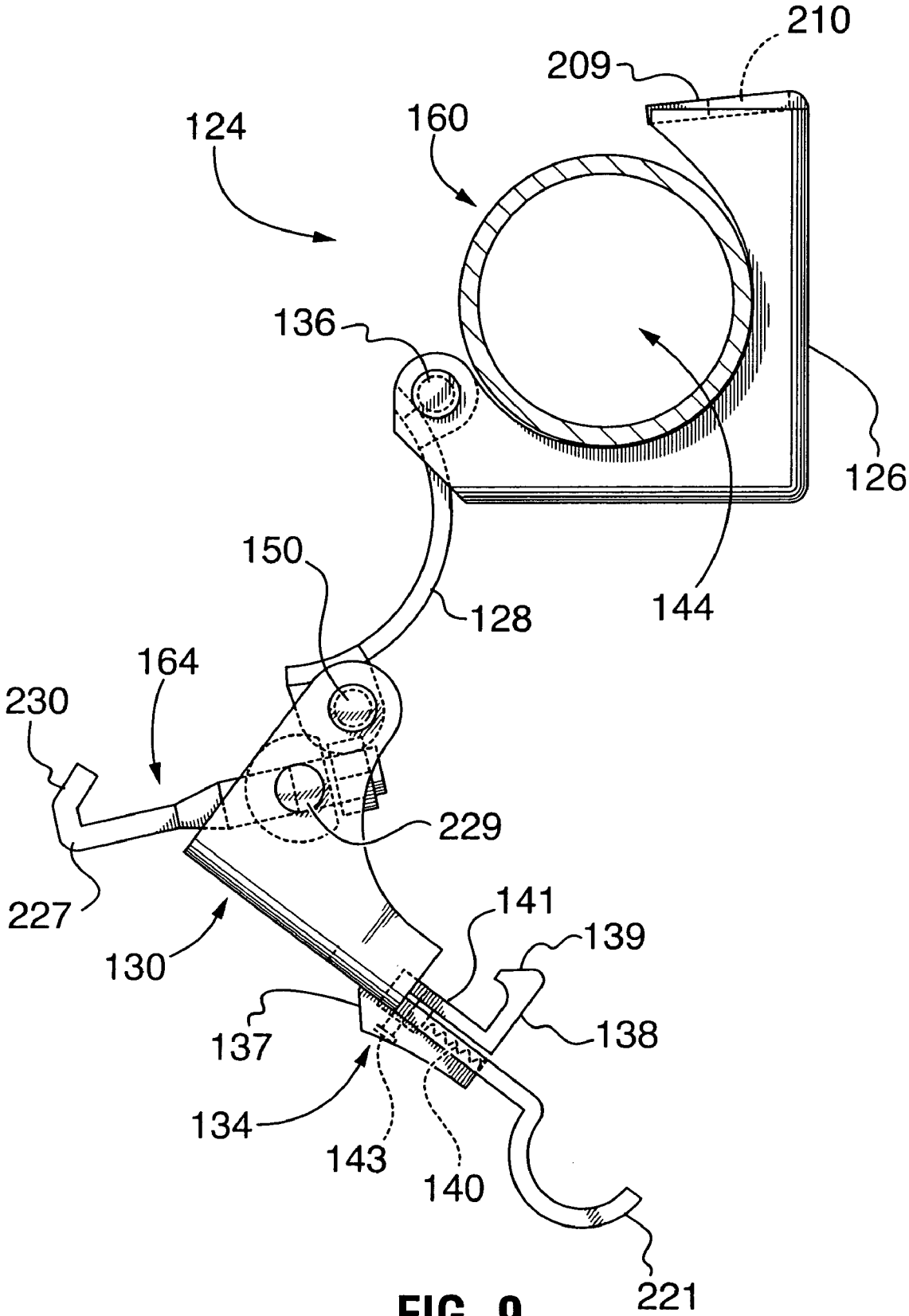
FIG. 9 is a side view of a coupler of the hand-lever triple coupler of FIG. 7, with a scaffold member, in an open position.
Figure 10:
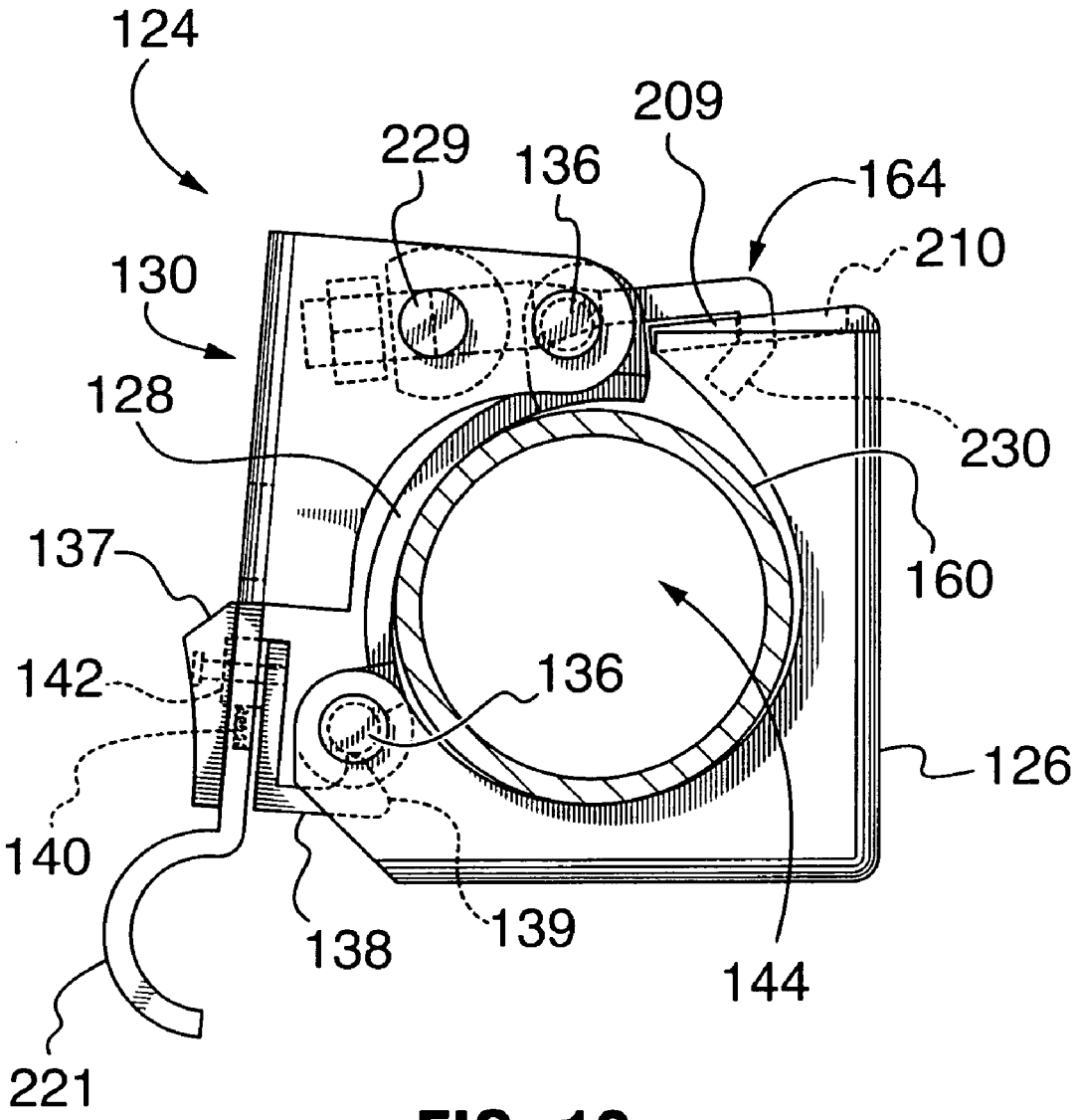
FIG. 10 is the coupler of FIG. 9, shown to a larger scale, in an almost closed position.

A security device 134, FIGS. 9, 10, has a catch 137 slidably positioned at an outer face of the hand lever 130. An L-shaped hook member 138 having a hook 139 and a plate 141 joined at a right angle is slidably positioned at the inner face of the hand lever 130. The catch 137 and the plate 141 of the L-shaped hook member 138 are interconnected and held in position by a screw 143 extending through the hole 225 in the hand lever 130. A spring 140 is located in the hole 225 between an extension 142 of the L-shaped hook member 138 protruding through the hole 225 and one end of the hole 225. The spring 140 is retained in the hole 225 by the plate 141 and the catch 137, which block opposite sides of the hole 225. The catch 137 and the L-shaped hook member 138 are biased away from the handle 221 by the spring 140.

The operation of the coupler 124 is described with regard to FIGS. 9 and 10. A scaffold member 160 is placed in the pocket 144. The hand lever 130 is used to rotate the inner lever 128 to close the pocket 144. At the same time, the T-shaped assembly 164 is rotated until the hook 230 is inserted into the hole 210 of the base 126 and hooked around the plate 209. The hand-lever 130 is then counter rotated until the hook 139 catches around the hinge pin 136. The spring 140 biases the hook 139 around a central part of the hinge pin 136 to secure the coupler 124.

The over-centre design on the hand lever 130 also helps to hold the coupler 124 closed. The hook member 227 pivots around the protrusions 229. When closed, the axis of protrusions 229 lies below a plane defined by the hinge pin 136 and the edge of the hole 210. In this configuration, the outward force of the scaffold member 160 operating along that plane tends to further rotate the hook member 227 around the axis of the protrusions 229 to force the protrusions 229 downward rather than opening the coupler.

The functional length of the hook member 227 may be adjusted by rotation of the nut 236 to vary the force required to release the hand lever. A set of double convex washers (not shown) are placed over the bolt end 234 before threading the nut 236 onto the bolt end 234 in order to provide the resistance necessary to accommodate the over centre locking action of the hook 230.

To release coupler 124, the catch 137 is depressed towards the handle 221 to press the extension 142 against the spring 140. The compression of the spring 140 allows the L-shaped hook member 138 to clear the hinge pin 136 when the hand lever 130 is rotated so that the protrusions 229 are above the plane of the hinge pins 136 and the edge of the hole 210.

The gripping action of the hand lever coupler 124 coupler may not be as secure as other couplers described herein but has the advantage of rapid action.

It will be understood that the grip of the couplers herein described can be improved by designing some indentations on portions of the couplers which contact the scaffolding members. For example, the grip of the coupler described with reference to FIGS. 7 to 10 can be improved by designing some indentations on the curve plate 215 which contacts the scaffold tube.

Both the coupler and the scaffold members described herein are typically comprised of steel or aluminum but may be made of any suitable material. Additionally, the scaffold members are shown to be tubular but may be of other cross-sectional shapes including rectangular members.

Alternative arrangements of the triple coupler are contemplated including interconnecting the couplers at other angles or pivotally interconnecting them. Additionally, other means of interconnecting the couplers may be used such as welding or casting as a unitary assembly.

Although the couplers may be used in different orientations, it is preferable to utilize a bolt-and-nut coupler for the vertical scaffold member because it achieves a firmer grip and is less prone to unintended loosing.

It will also be understood that the couplers described with respect to FIGS. 3 to 9 may be used for coupling devices other than triple couplers. In particular, they may be used for an orthogonal, a parallel or a rotatable two coupler apparatus.

The above description of embodiments should not be interpreted in any limiting manner since variations and refinements can be made without departing from the spirit of the invention. The scope of the invention is defined by the appended claims and their equivalents.

The invention claimed is:

1. A two coupler apparatus for interconnecting two scaffolding members wherein at least one coupler is defined by:

a base interconnected to a second coupler;

a lever hinged to the base, the base and the lever defining a pocket for laterally receiving a length of a scaffold member;

an arm hinged to the base;

the lever having a slot sized to receive the arm;

the arm defining a hole substantially parallel to a longitudinal axis of the pocket and positioned to extend beyond the lever when the arm is within the slot;

a wedge adapted for insertion through the hole substantially parallel to the longitudinal axis of the pocket to slidably move against the lever when the arm extends within the slot to wedge the arm within the lever whereby the scaffold member is locked within the at least one coupler.

2. A two coupler apparatus for interconnecting two scaffolding members wherein at least one coupler is defined by:

a base interconnected to a second coupler;

a lever hinged to the base, the base and the lever defining a pocket for laterally receiving a length of a scaffold member;

an arm hinged to the base, the arm having a protrusion at a free end;

the lever having a slot adapted to receive the arm;

a circular wedge pivotally mounted on the arm, the circular wedge gradually increasing in thickness in a direction of travel around a circumference of the circular wedge to define a cam surface for engagement with the protrusion;

the circular wedge being rotatable on the arm between the lever and the protrusion in a direction of increasing thickness to create a wedging action between the protrusion and the cam surface acting to press the lever onto the scaffold member to lock the scaffold member within the pocket.

3. A two coupler apparatus for interconnecting two scaffolding members wherein at least one coupler is defined by:

a base interconnected to a second coupler;

a lever hinged to the base, the base and the lever defining a pocket for laterally receiving a length of a scaffold member;

an over-centre hand-lever mechanism for intercoupling the base and the lever, the over-centre hand-lever mechanism having a hand lever that is hinged to the lever and an adjustable length hook member that is hinged to the hand lever;

wherein the adjustable length hook member is selectively engageable with the base and the over centre hand-lever mechanism is selectively actuatable to lock the lever and the base to a scaffold member by turning the hand lever about its hinge with the lever while the adjustable length hook member is engaged with the base.

4. The two coupler apparatus of claim 3 further comprising a latching device which operates, when the locking device is locked, to clamp the hand lever to the lever, the clamping device comprising:

a second hook member attached to the hand lever and biased to clamp to the hinge interconnecting the base and the lever.

5. The two coupler apparatus of claim 1 wherein the at least one coupler is pivotally attached to the second coupler.

6. The two coupler apparatus of claim 1 wherein the at least one coupler is orthogonally fixed to the second coupler.

7. The two coupler apparatus of claim 1 wherein the at least one coupler is attached parallel to the second coupler.

8. The coupling apparatus of claim 1 wherein the base further comprises a means of limiting the rotation of the arm from a vertical extension when the arm is not engaged with the lever.

9. The two coupler apparatus of claim 2 wherein the at least one coupler is pivotally attached to the second coupler.

10. The two coupler apparatus of claim 3 wherein the at least one coupler is pivotally attached to the second coupler.

11. The two coupler apparatus of claim 2 wherein the at least one coupler is fixed orthogonally to the second coupler.

12. The two coupler apparatus of claim 3 wherein the at least one coupler is fixed orthogonally to the second coupler.

13. The two coupler apparatus of claim 2 wherein the at least one coupler is attached parallel to the second coupler.

14. The two coupler apparatus of claim 3 wherein the at least one coupler is attached parallel to the second coupler.

* * * * *